United States Patent [19]

Möck

[11] Patent Number: 4,993,858

[45] Date of Patent: Feb. 19, 1991

[54] APPLICATOR DEVICE FOR COSMETIC USES

[75] Inventor: Gerhard Möck, Kirchehrenbach, Fed. Rep. of Germany

[73] Assignee: Messrs. Schwan-Stabilo Schwanhausser GmbH & Co, Nuremberg, Fed. Rep. of Germany

[21] Appl. No.: 548,014

[22] Filed: Jul. 5, 1990

[30] Foreign Application Priority Data

Apr. 14, 1990 [DE] Fed. Rep. of Germany ..... 4012198

[51] Int. Cl.[5] ..... A45D 40/00; A45D 40/20

[52] U.S. Cl. ..... 401/34; 401/88; 401/68

[58] Field of Search ..... 401/17, 19, 34, 88, 401/265, 266, 205, 68, 73, 98

[56] References Cited

U.S. PATENT DOCUMENTS

| | | | |
|---|---|---|---|
| 1,577,548 | 3/1926 | Upton | 401/88 |
| 2,177,651 | 10/1939 | Harris | 401/19 |
| 2,337,979 | 12/1943 | Dorner | 401/75 |
| 2,376,944 | 5/1945 | Songer . | |
| 2,460,299 | 2/1949 | Kruck | 401/196 X |
| 2,710,614 | 6/1955 | Dulberg | 401/34 |

FOREIGN PATENT DOCUMENTS

| | | | |
|---|---|---|---|
| 1193220 | 4/1959 | France . | |
| 1394920 | 3/1965 | France | 401/88 |
| 268337 | 8/1950 | Switzerland | 401/34 |

*Primary Examiner*—Richard J. Johnson

*Attorney, Agent, or Firm*—Bachman & LaPointe

[57] ABSTRACT

An applicator device for cosmetic uses comprises a tubular casing accommodating at least one stick of cosmetic material which projects from the casing. At each of the two axially mutually remote ends of the casing the internal space within the casing includes respective end portions which are each defined in respect of their axial dimension by a stick abutment means for fixing the position of a respective stick in the internal space end portion. One or both internal space end portions may accommodate a respective cosmetic stick, and the two end portions of the space within the tubular casing are of the same configuration to minimize the sorting expenditure involved when processing casings.

11 Claims, 2 Drawing Sheets

APPLICATOR DEVICE FOR COSMETIC USES

BACKGROUND OF THE INVENTION

Applicator devices for cosmetic uses, of a pencil-like form for the application of cosmetic material such as eye shadow, lipstick or the like, typically comprise a pasty stick of the cosmetic material to be applied. Such devices are frequently used for sampling purposes to enable a potential purchaser to try out the respective cosmetic material, for example to choose an appropriate shade of color. In order to cover a wide range of different colors and types of cosmetic material therefore, it is necessary to provide a large number of sampler devices and that can involve a substantial cost level as well as a considerable amount of storage space.

In an endeavour to deal with such problems, an applicator device for cosmetic uses has been developed, as set forth in U.S. patent application No. 07/491,861 of Mar. 12th 1990. That applicator device for cosmetic uses comprises a stick disposed in a casing and projecting therefrom with an applicator end portion. The casing includes a tubular element of an axial lengthwise extent substantially of between 20 and 60 mm, and with an outside diameter substantially of between 3 and 8 mm. The end portion of the internal space defined within the tubular element, for axially definedly receiving and mechanically firmly holding the stick in the casing, has a stick abutment means which reduces the internal cross-section of the tubular element, to define the position of the stick in the casing, and, at a spacing from the stick abutment means in the axial direction of the casing, at least one stick retaining means which also reduces the internal cross-section of the tubular element, to hold the stick in the casing, with the stick abutment means and retaining means being integrally formed on the tubular element. The stick is of an axial lengthwise dimension substantially of between 5 and 20 mm while its diameter in substantially between 2 and 5 mm. The above-mentioned stick abutment means thus defines within the space within the tubular element of the casing, an end portion for receiving the stick of cosmetic material, while the other end portion of the casing serves more particularly for receiving a closure plug to close the casing at that second end. The fact that the casing of that applicator device is of a non-symmetrical configuration means that the applicator device involves a not inconsiderable amount of manipulation in order for the individual casings of the devices to be fed in exactly the right positive to an operating station in which the individual casings are each provided with a respective stick of cosmetic material. The operation of suitably orienting the casings has a detrimental effect on the cycle times involved in the manufacture of such applicator devices, and also on the production costs thereof.

SUMMARY OF THE INVENTION

An objection of the present invention is to provide an applicator device for cosmetic uses, which is of such a design configuration that the amount of manipulation involved in fitting the casings of the devices with respective sticks of cosmetic material can be comparatively reduced.

Another object of the present invention is to provide an applicator device for cosmetic uses which, while being of a simple design and inexpensive to produce, affords a considerable degree of flexibility and versatility in regard to use thereof.

Still another object of the present invention is to provide an applicator device for cosmetic uses, which is simple to manufacture while affording enhanced options in regard to use thereof with different cosmetic materials.

In accordance with the present invention these and other objects are attained by an applicator device comprising a stick disposed in a casing and having an application portion which projects therefrom. The casing comprises a tubular element with an axial lengthwise extent substantially of between 20 and 60 mm, with an outside diameter substantially of between 3 and 8 mm. The casing defines an internal space therewithin. At each of its two axially mutually remote ends the casing has an end portion of said internal space, which is delineated in the axial direction of the casing by a respective stick abutment means which reduces the internal cross-section of the tubular element. The two internal space end portions are of at least substantially the same configuration. Within each end portion, at a spacing from the respective stick abutment means, are respective stick retaining elements which also reduce the internal cross-section of the tubular element. The stick abutment means and the stick retaining elements are integrally formed on the tubular element of the casing. The stick to be fitted into a said internal space end portion is of an axial lengthwise dimension substantially of between 5 and 20 mm, with a diameter which is substantially between 2 and 5 mm.

A casing of the configuration outlined above, with two at least substantially identical internal space end portions gives the advantage that there is no need for a sorting operation when dealing with the casings in the course of manufacture of applicator devices, that is no say, when fitting sticks of cosmetic material to the respective casings, so that it is possible to fit suitable sticks of cosmetic materials to the respective casings in an automatic production line in comparatively short production cycle times. Further advantages of the above-defined configuration according to the invention are that the casings, being of a symmetrical configuration, are simple to produce as by molding and consequently can be manufactured as a mass-produced item with a low level of production expenditure.

In a preferred feature of the applicator device according to the invention, a stick of an extruded cosmetic material may be fixed in each of the two internal space end portions defined at respective ends of the casing. In accordance with another feature of the invention however it is possible for a stick of extruded material to be fixed in one end portion of the internal space in the casing, while a stick of a cast material is fixed in the other internal space end portion in the casing. That consequently makes it possible to combine two cosmetic sticks of different consistencies and accordingly with different application characteristics, in a single applicator device. The cast stick may be a stick which is cast in a mold and then introduced into the casing. It will be appreciated however that it is also possible for a suitable cosmetic material to be introduced directly into the casing, to provide a cast stick thereto, with the tip of the stick possibly being formed on the cast stick in the same operation.

Irrespective of whether the applicator device comprises a casing with two extruded sticks at each end of the casing, or a cast stick at one end and an extruded stick at the other end, the two sticks of the applicator device according to the invention may comprise a material which is at least approximately of the same color, or materials of different colors. It will thus be readily seen that the applicator device according to the invention advantageously affords a wide range of different options in regard to combining sticks of cosmetic materials of different natures or colors and the like. While the casing may be fitted with two cosmetic sticks at respective ends thereof, it will however also be appreciated that, in spite of the casing being of a symmetrical configuration, if may also be provided with only a single stick which may be either an extruded stick or a cast stick. If the casing is fitted with a cast stick, it will be appreciated that in that case it is also possible for the cast stick not to be delimited by the stick abutment means in the corresponding end portion of the internal space in the casing, but the stick may fill up at least the major part of the internal space in the casing.

When the applicator device is provided with a single cast or extruded stick, the end of the casing remote from the end which accommodates the stick may be provided in the casing interior, which is free from stick material, with an advance element for pushing the stick out of the casing. The advance element may be provided with an actuating member and an externally screwthreaded portion, in a similar fashion to the applicator device in accordance with U.S. patent application No. 07/491,854 to which reference is accordingly directed. So that an advance element of that kind can be appropriately screwed into the casing, the casing may be provided with a suitable internally screwthreaded portion. As however the production of a casing with an internal screwthread in that way involves an increased level of manufacturing cost, in a preferred feature of the applicator device according to the present invention of the kind referred to above with a stick which is displaceable in the casing by means of the advance element, the advance element may comprise a harder material than the casing of the applicator device. That choice of materials means that it is possible to omit the specific operation of forming an internal screwthread within the casing to receive the advance element, for example by means of a suitable molding tool, because an advance element consisting of a harder material than the casing of the applicator device will itself cut its own screwthread into the softer material of the casing when the advance element is actuated by means of its actuating member, and is thus screwed into the casing in order to cause the stick to extend from the other end of the casing.

In accordance with a preferred feature of the invention, it is advantageous for the casing of the applicator device to be formed from a resiliently yielding or flexible plastic material in order that the stick abutment means at each of the two end portions of the internal space in the casing and in particular also the stick retaining elements which likewise reduce the internal cross-section of the tubular element of the casing or the end portions of the internal space defined within the casing can be readily formed as by molding, without having to use expensive molding equipment for that purpose. More specifically, when using a suitably resiliently yielding plastic material, it is possible to provide in particular the above-mentioned stick retaining elements by the provision of undercut configurations in the casing in per se known manner.

For the purposes of protecting the application portion of the or each stick which projects out of the casing, an associated closure cap may preferably be removably carried on the casing.

Further objects, features and advantages of the applicator device in accordance with the principals of the present invention will be apparent from the following description of preferred embodiments thereof.

DESCRIPTION OF PREFERRED EMBODIMENTS

Figure 1:
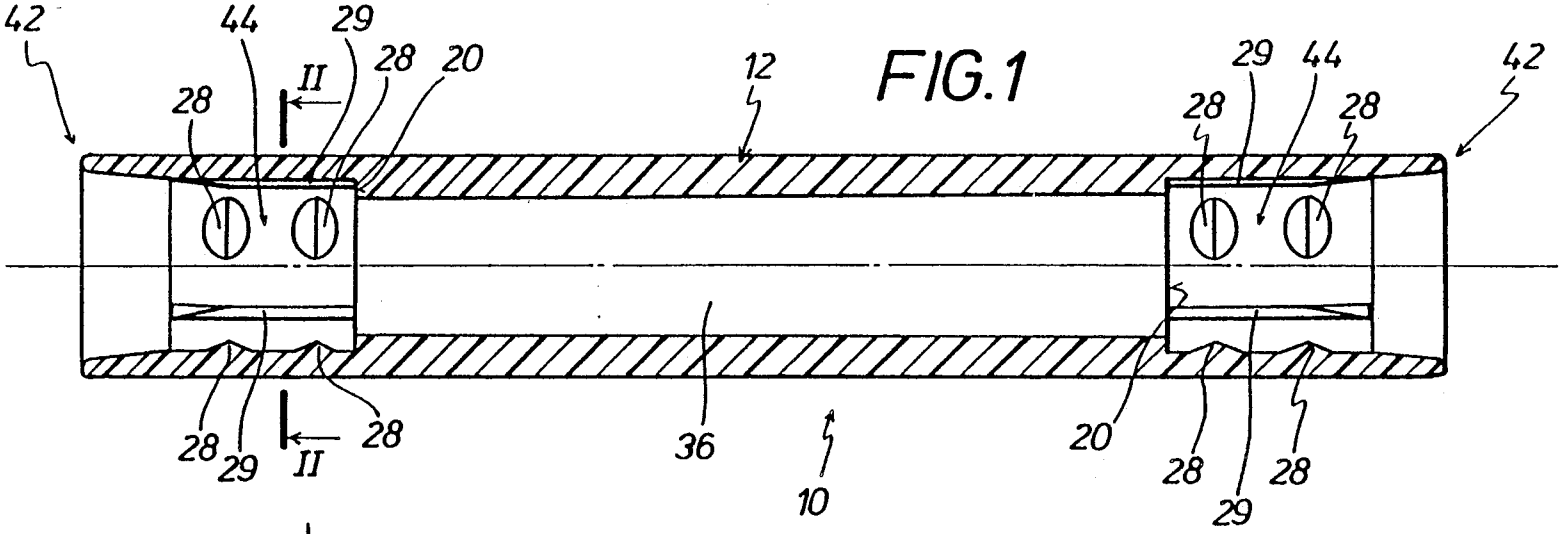
FIG. 1 is a view in longitudinal section through a casing of a first embodiment of an applicator device, shown on a greatly enlarged scale.

Referring firstly to FIG. 1, shown therein at 10 on a greatly enlarged scale is an applicator device for cosmetic use, comprising a casing 12 in the form of a tubular element having a central internal space 36 defined therewithin. The space 36 includes a respective end portion 44 at each of the two mutually axially remote ends 42 of the casing 12 of the applicator device 10. The end portions 44 of the internal space 36 will be referred to hereinafter for simplicity as internal space end portions 44.

It will be seen from FIG. 1 that each internal space end portion 44 is delineated in respect of its axial extent by a respective stick abutment as indicated at 20, and the two internal space end portions 44 are of at least substantially identical configuration.

Each of the two internal space end portions 44 is provided with stick retaining elements or portions 28 which reduce the internal cross-section of the corresponding internal space end portion 44. Furthermore each internal space end portion 44 has ribs 29 which can be clearly seen from FIG. 2 and which also reduce the internal cross-section of the corresponding internal space end portion 44. The ribs 29 extend in the axial direction of the casing 12 and serve in particular to prevent a stick (not shown) of cosmetic material which is disposed in the respective internal space end portion 44 from accidentally and unintentionally turning within the casing 12.

The stick retaining elements 28 and the stick abutment 20 are provided to prevent the stick disposed in the corresponding internal space end portion 44 from being displaced within the casing 12 in the axial direction thereof, more particularly inwardly of the casing 12.

Figure 2:
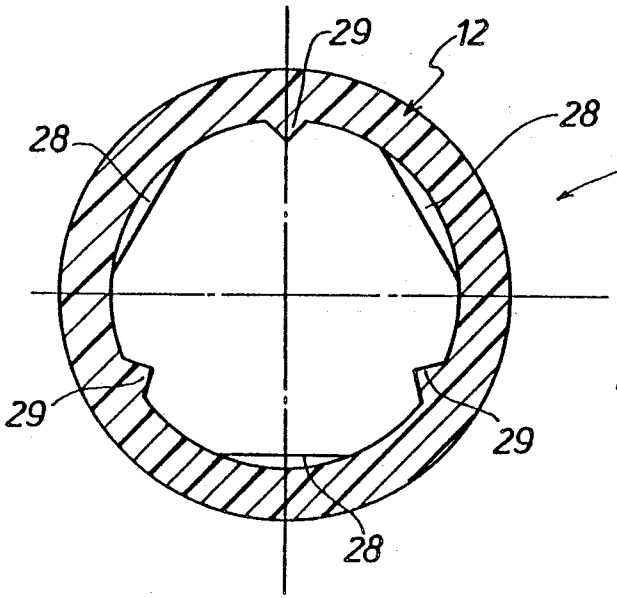
FIG. 2 is a view in cross-sectional through the applicator device shown in FIG. 1, taken along line II—II.

It will also be seen from FIG. 2 that both the stick retaining elements 28 and also the ribs 29 are at least substantially uniformly distributed around the periphery of the casing 12 on the internal wall surface thereof.

Figure 3:
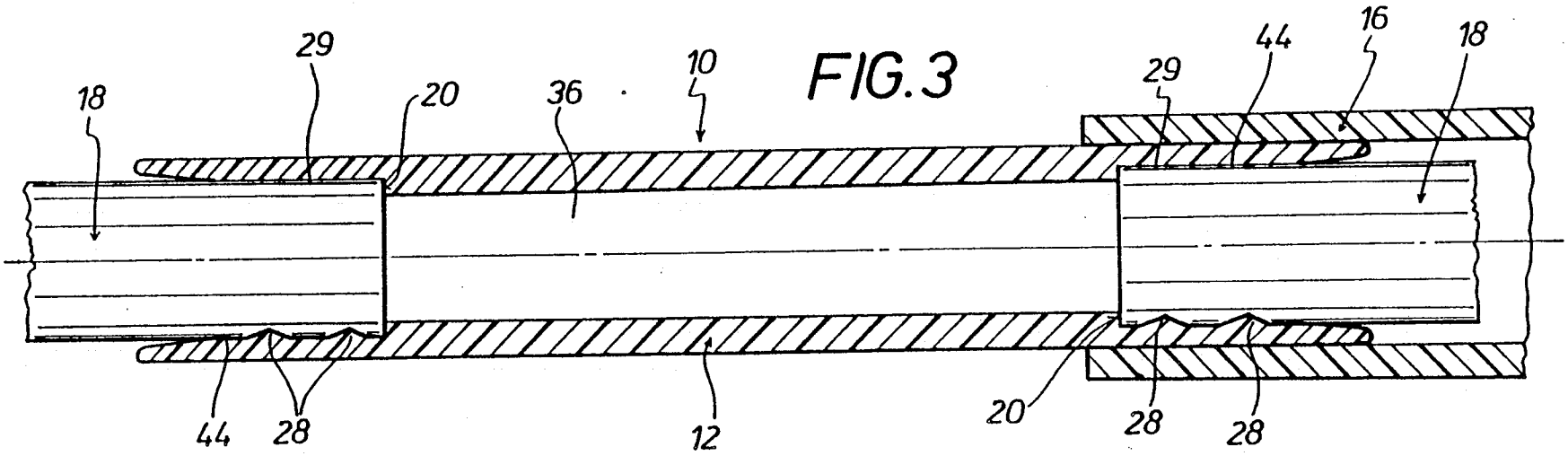
FIG. 3 is a view similar to that shown in FIG. 1 through a casing fitted with first and second extruded sticks of which only portions are shown, with a portion of a closure cap also being indicated at the right-hand end of the device in FIG. 3.

Reference will now be made to FIG. 3 showing a view in longitudinal section of an applicator device 10 having a casing 12 provided with first aid second sticks 18 of cosmetic material, only portions thereof being shown in FIG. 3. The sticks 18 are sticks of an extruded cosmetic material and they bear against corresponding stick abutments 20 defined by the inside wall surface of the casing 12 in the respective internal space end portions 44. The stick abutments 20 prevent the sticks 18 from being unintentionally moved into the space 36 within the casing 12, for example when a pressure is applied to the stick 18 when it is being used to apply cosmetic material. The stick retaining elements 28 and the ribs 29 also serve to prevent the corresponding stick 18 from turning with respect to the casing 12.

In FIG. 3, at the end of the casing 12 which is at the right-hand side in the drawing, reference numeral 16 indicates a closure cap of which part only is shown and which is provided to protect the associated stick 18 at that end of the casing 12.

It will be seen from FIG. 3 and the description relating thereto that each stick 18 is mechanically firmly held within the casing 12, in the respective internal space end portions 44, in axially defined positions. The stick abutments 20 and the stick retaining elements 28 are formed integrally with the casing 12 in the interior thereof.

Figure 4:
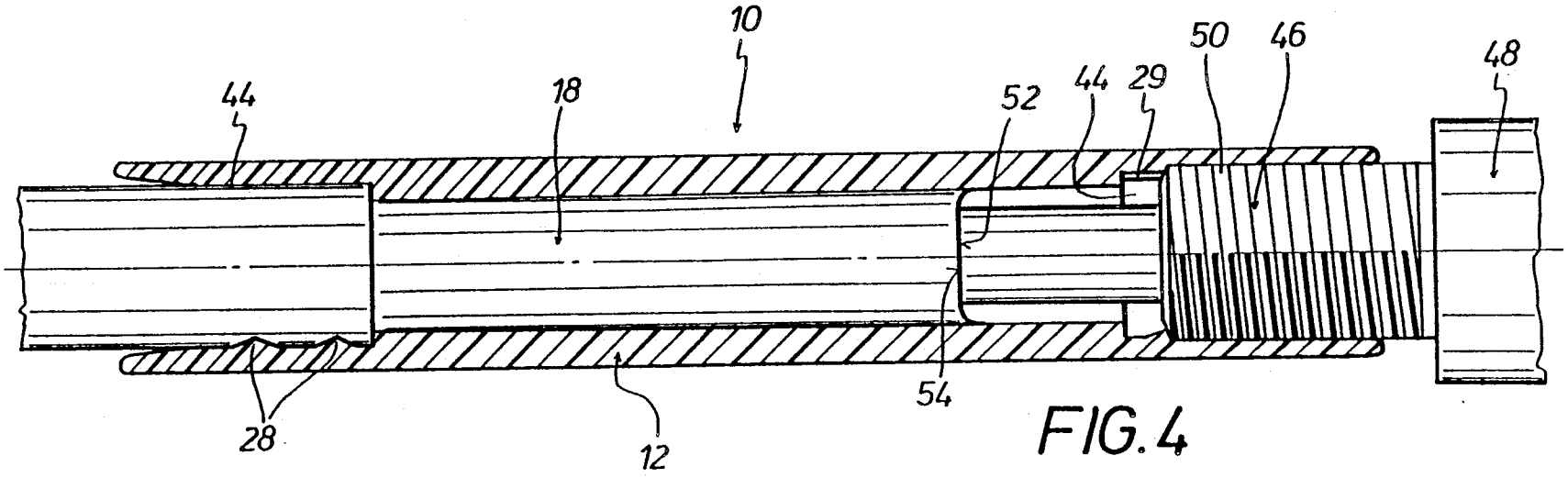
FIG. 4 is a view in longitudinal section through an embodiment of the applicator device with a cast stick at one end and an advance element of which a portion is shown at the other end, for extending the stick out of the casing of the device.

Referring now to FIG. 4, shown therein is a view in longitudinal section of an applicator device 10 having a casing 12 with a stick 18 cast into the internal end space 44 of the casing 12, which is at the left-hand side in FIG. 4. The stick 18 has a portion projecting out of the end of the casing 12, to provide a cosmetic material application portion. Only part of the application portion of the stick 10 is shown in the drawing in FIG. 4. So that the stick 18 can be displaced towards the left as desired to extend the application portion thereof further out of the casing 12, the FIG. 4 embodiment has an advance element 46 comprising an actuating member 48 of which only part is shown, and an externally screwthreaded portion 50. The advance element 46 bears by way of an end face 52 thereof against the rear end face indicated at 54 of the stick 18. By turning the advance element 46, the externally screwthreaded portion 50 thereof is screwed into the casing 12 so that at the same time the stick 18 is pushed out of the casing 12 at the other end thereof, in the axial direction of the casing 12. As mentioned above, the externally screwthreaded portion 50 of the advance element 46 may co-operate with an internal screwthread provided in the internal surface of the casing 12 in the internal space end portion thereof, by a suitable tool, or alternatively the external screwthread on the portion 50 of the advance element 46 may cut its own screwthread into the inside wall surface of the internal space end portion 44, by virtue of at least the portion 50 being of a harder material than the material forming the casing 12.

In the above-described embodiments of the device according to the invention the tubular element of the casing 12 has an axial lengthwise extent substantially of between 20 and 60 mm, with an outside diameter substantially of between 3 and 8 mm. The or each stick 18 is of an axial lengthwise dimension substantially of between 5 and 20 mm with a diameter substantially of between 2 and 5 mm.

It will be appreciated that the above-described constructions have been set forth solely by way of example and illustration of the present invention and that various modifications and alterations may be made therein without thereby departing from the spirit and scope of this invention.

I claim:

1. In an applicator device for cosmetic uses comprising: an elongate casing including a tubular element having first and second ends of an axial lengthwise extent substantially of between 20 and 60 mm and an outside diameter substantially of between 3 and 8 mm, the tubular element providing an internal space inside same having an internal space end portion at said first end; a stick of cosmetic material, of an axial lengthwise dimension substantially of between 5 and 20 mm and a diameter substantially of between 2 and 5 mm, the stick being axially definedly received and mechanically firmly held in the internal space end portion at the first end of the casing and providing an application portion projecting out of the first end of the casing; and the casing including an abutment means which reduces the internal cross-section of the tubular element and which fixes the axial extent of said internal space end portion, for defining the position of the stick in said internal space end portion in the axial direction of the casing, and at a spacing from said stick abutment means in the axial direction of the casing at least one stick retaining means which reduces the internal cross-section of said internal space end portion for holding the stick in the casing, the stick abutment means and the stick retaining means being integrally formed on the tubular element; the improvement which provides that at the second end of the casing said internal space in said tubular element has a second end portion of an axial extent fixed by a respective said stick abutment means and adapted to receive a said stick, the internal space end portions at said first and second ends of said casing being of at least substantially the same configuration.

2. An applicator device as set forth in claim 1 including a stick of an extruded material fixed in each of the first and second internal space end portions of the casing.

3. An applicator device as set forth in claim 1 including a stick of an extruded material fixed in one internal space end portion of the casing and a stick of a cast material fixed in the other internal space end portion of the casing.

4. An applicator device as set forth in claim 2 wherein the sticks comprise material which is at least approximately of the same color.

5. An applicator device as set forth in claim 2 wherein the sticks comprise materials of different colors.

6. An applicator device as set forth in claim 3 wherein the sticks comprise material which is at least approximately of the same color.

7. An applicator device as set forth in claim 3 wherein the sticks comprise materials of different colors.

8. An applicator device as set forth in claim 1 including a stick of cast material in one of the first and second internal space end portions.

9. An applicator device as set forth in claim 8 and further including at the end of the casing which is remote from said stick, in a part of said internal space which is free from stick material, an advance element for pushing the stick out of the casing.

10. An applicator device as set forth in claim 7 wherein said advance element comprises an actuating member and an externally screwthreaded portion.

11. An applicator device for cosmetic use comprising: an elongate casing having a first end and a second end and including a tubular element of an axial lengthwise extent substantially of between 20 and 60 mm and an outside diameter substantially of between 3 and 8 mm, the tubular element providing a space inside same; a stick for cosmetic material of an axial lengthwise dimension substantially of between 5 and 20 mm and of a diameter substantially between 2 and 5 mm, which is axially definedly received and mechanically firmly held in the tubular element of the casing at a first end thereof and which provides an application portion projecting out of said first end of the casing; a respective abutment means in the casing at a spacing from each of the first and second ends thereof, each abutment means reducing the internal cross-section of the space in the tubular element to define the position of the stick in the casing in the axial direction thereof and each abutment means delineating a respective end portion of said space in respect of the axial extent thereof, the two end portions of said space within said tubular element being of at least substantially the same configuration, and at a spacing from each said stick abutment means in the axial direction of the casing at least one respective stick retaining means which reduces the internal cross-section of the space in the tubular element for holding the stick in the casing, the stick abutment means and the stick retaining means being integrally formed on the tubular element.

* * * * *